US006351250B1

(12) United States Patent
Gillen

(10) Patent No.: US 6,351,250 B1
(45) **Date of Patent: *Feb. 26, 2002**

(54) ANTENNA TOWER AND SUPPORT APPARATUS

(76) Inventor: Glenn P. Gillen, 4425 Wade Dr., Metairie, LA (US) 70003

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/545,985

(22) Filed: Apr. 10, 2000

(51) Int. Cl.[7] ..... H01Q 1/12
(52) U.S. Cl. ..... 343/890; 52/40
(58) Field of Search ..... 343/890, 872, 343/891; 52/111, 40, 651.07

(56) References Cited

U.S. PATENT DOCUMENTS

| | | | | |
|---|---|---|---|---|
| 1,116,111 A | | 11/1914 | Pfund | 455/73 |
| 3,768,016 A | | 10/1973 | Townsend et al. | 325/1 |
| 4,899,500 A | | 2/1990 | Miller et al. | 52/146 |
| 4,912,893 A | | 4/1990 | Miller et al. | 52/79 |
| 5,162,807 A | | 11/1992 | Ursenbach et al. | 343/763 |
| 5,200,759 A | | 4/1993 | McGinnis | 343/890 |
| 5,581,958 A | | 12/1996 | Cote | 52/40 |
| 5,904,004 A | | 5/1999 | Hill | 52/40 |
| 5,911,117 A | * | 6/1999 | Bhame et al. | 455/90 |
| 5,969,693 A | | 10/1999 | Legg | 343/890 |

* cited by examiner

*Primary Examiner*—Don Wong
*Assistant Examiner*—James Clinger
(74) *Attorney, Agent, or Firm*—Garvey, Smith, Nehrbass & Doody, LLC

(57) ABSTRACT

An antenna tower and support apparatus includes a foundation and a building mounted on the foundation, the building including a plurality of vertically spaced apart building sections (preferably two, three or more), a bottom and a top. A tower is supported upon the top of the building. A plurality of antenna are attached at multiple elevational positions. Each building section has a security area that is separate from the security area of the other building sections. A plurality of antenna portals are provided at least one on each building section. A plurality of antenna cables are provided, each cable extending from an antenna to a security area of a building section via an antenna portal, wherein each security area has at least one antenna cable that extends to it. Each security area has telecommunications equipment that is connected to one of the antenna cables.

40 Claims, 8 Drawing Sheets

FIGURE 5 – EXISTING PRIOR ART

ANTENNA TOWER AND SUPPORT APPARATUS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to tall tower and building arrangements where used for structural and electronic support of antenna. Even more particularly, the present invention relates to an improved antenna tower and support apparatus that features an improved configuration of multiple equipment rooms, multiple sets of antenna cable, and multiple sets of antennae at different elevations on a tower.

2. General Background of the Invention

Very tall towers are typically used to support one or more antennae at desired elevational positions. One of the most common usages of such a tower is in the cellular telephone industry. Other examples of such antenna supporting towers include radio, pagers, television, and two-way radio.

One of the means of defraying the expense of constructing such a tall antenna supporting tower is to provide multiple users with multiple electronic support/equipment rooms. This provision of multiple rooms and multiple sets of antenna associated with a single tower can present security problems. It is to this problem that the present invention is directed.

Numerous patents have issued that are directed to very tall towers which support either a single antenna or multiple antennae. Examples of such patents are contained in the following table:

Prior Art Patents

| Patent # | Title | Issue Date |
|---|---|---|
| 1,116,111 | Station for the Transmission and reception of Electromagnetic Wave Energy | 11/1914 |
| 3,768,016 | Modular, Prefabricated, Integrated Communications Relay Tower | 10/1973 |
| 4,899,500 | CMR Cell Site | 02/1990 |
| 4,912,893 | Transportable CMR Cell Site | 04/1990 |
| 5,162,807 | Architectural Structure Combining At Least One Antenna With Supporting Mast Positioned on the Ground and at Least One High-Power Transmitter | 11/1992 |
| 5,200,759 | Telecommunications Tower Equipment Housing | 04/1993 |
| 5,581,958 | Pole and Cabinet Structure for Antenna-Mounting at Communications Site | 12/1996 |

-continued

Prior Art Patents

| Patent # | Title | Issue Date |
|---|---|---|
| 5,904,004 | Integrated Communications Equipment Enclosure and Antenna Tower | 05/1999 |
| 5,969,693 | Multi-User Antenna Telecommunication Tower | 10/1999 |

BRIEF SUMMARY OF THE INVENTION

The present invention provides an improved antenna tower and support apparatus that include both structural support for the antenna and its tower as well as telecommunications support via equipment and cabling.

The apparatus includes a foundation which can include piling, if necessary. A building is mounted on the foundation including a plurality of vertically spaced apart building sections (for example, two or three). The building itself includes a bottom that is next to the foundation and a top that is next to the tower.

A tower is supported upon the top of the building. This support can be in the form of legs of the tower that rest upon the tops of columns provided at intervals around the periphery of the building.

A plurality of antennae are attached to the tower at multiple elevational positions.

Each building section has a security area that is separate from the security area of other building sections.

A plurality of antenna portals are provided, at least one being provided on each building section and preferably communicating with a security area of a building section.

A plurality of antenna cables are provided that extend between the building and the various antennae. Each cable extends preferably from an antenna to a security area of a building via an antenna portal. Each security area has at least one antenna cable that extends to it and each security area has telecommunication equipment that is connected to one of the antenna cables.

The tower can be a self-supporting tower, a guyed tower, or a monopole. The tower can be a guyed tower that is guyed to the top of the building or to the surrounding terrain using appropriate anchors that are embedded in the earth.

At least one of the building sections has multiple antenna cable that enter its security area via an antenna portal.

The multiple antenna can include at least one microwave antenna, one whip antenna and/or one panel antenna. In some installations, the multiple antennae include different types of antennae placed at different elevational positions such as, for example, one microwave antenna and at least one panel antenna placed at different elevational positions.

The apparatus further comprises a single ground ring that is grounded below the earth's surface next to the building. The ground ring is preferably in the form of a ring that extends circumferentially around the foundation of the building, embedded in the earth.

The present invention thus provides an improved building, tower and antenna arrangement that does not require ice bridges, transformer foundations, or electrical backboard foundations.

The system of the present invention reduces uplift forces at ground level, thus reducing or eliminating the need for deep foundations.

The system of the present invention reduces the required length of tower because of the use of multiple building sections to elevate the lower end portion of the tower.

The system of the present invention reduces construction time and costs for future carriers/users.

The system of the present invention reduces land requirements, fencing, stone or gravel requirements and shortens fall radius of the tower.

BRIEF DESCRIPTION OF THE DRAWINGS

For a further understanding of the nature, objects, and advantages of the present invention, reference should be made to the following detailed description, read in conjunction with the following drawings, wherein like reference numerals denote like elements and wherein.

DETAILED DESCRIPTION OF THE INVENTION

Figure 1:
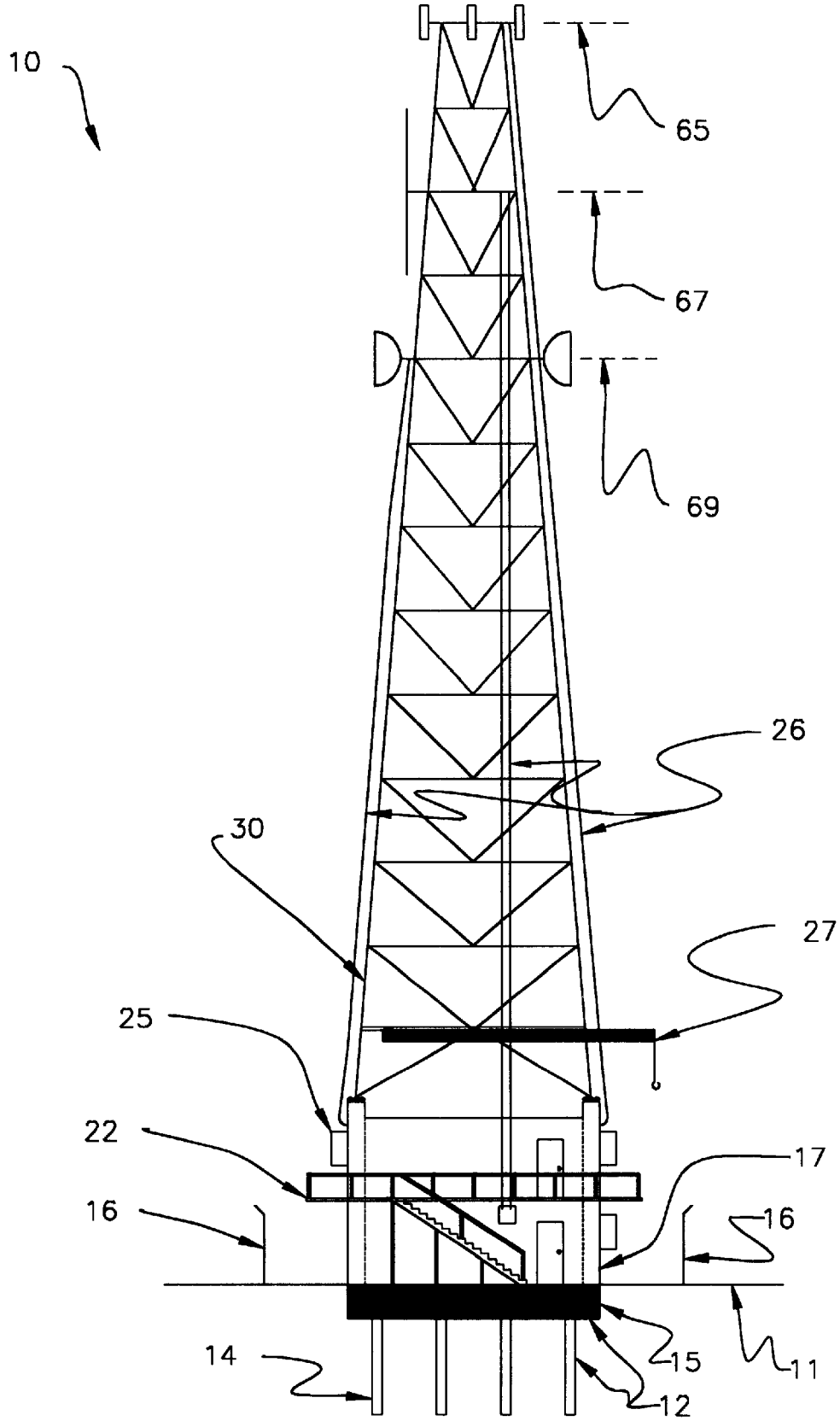
FIGS. 1 and 1A are elevation views of the preferred embodiment of the apparatus of the present invention.
Figure 1A:
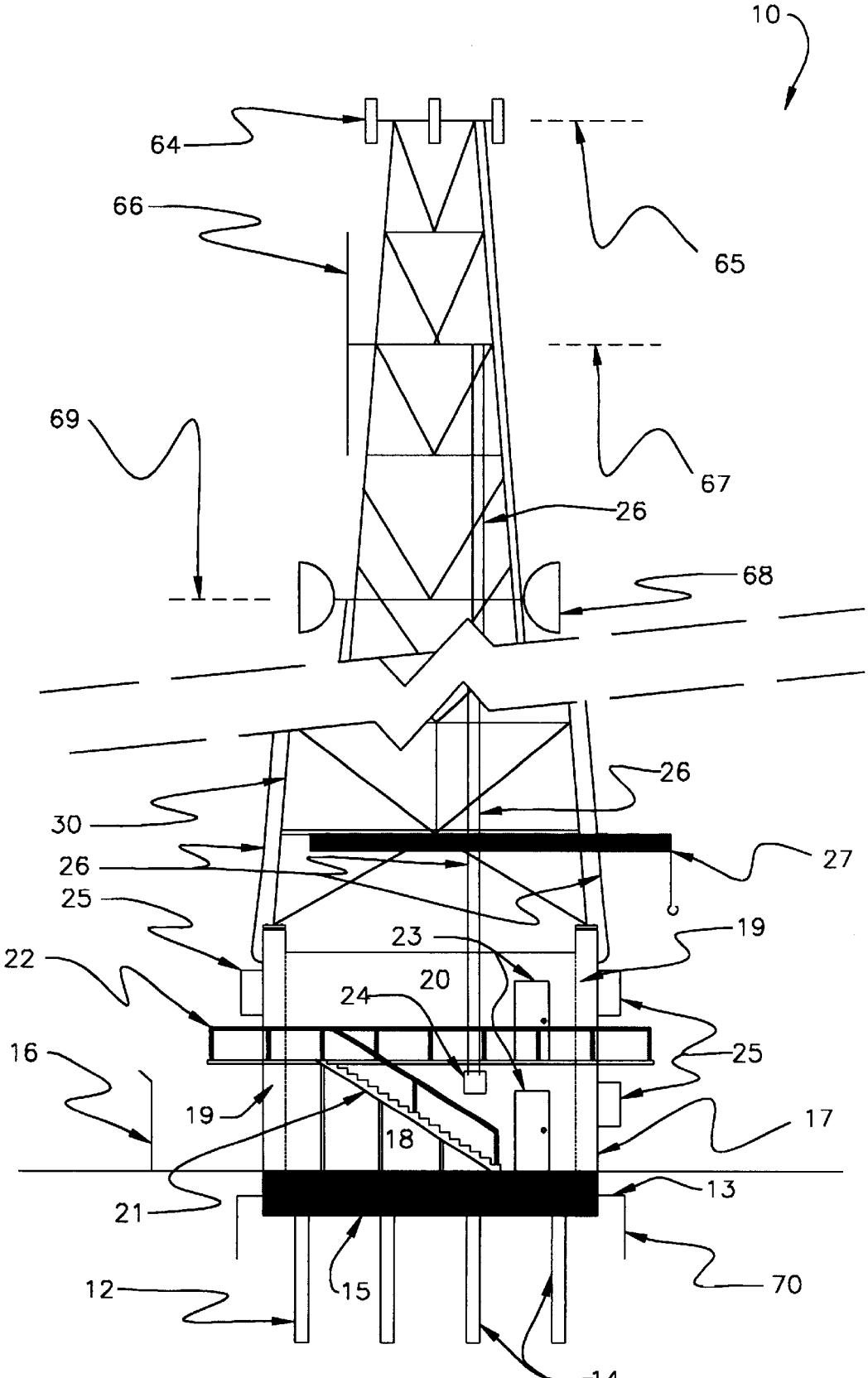

FIGS. 1, 1A, 6, 7A–7D and 8–9 show the preferred embodiment of the apparatus of the present invention, designated generally by the numeral 10 in FIGS. 1 and 1A. Antenna tower and support apparatus 10 is shown in its position relative to the earth surface 11 in FIGS. 1 and 1A. The antenna tower and support apparatus 10 includes a building foundation 12 that can include a plurality of piling 14 (optional) and a foundation cap 15.

A building ground ring 13 with ground rods 70 (commercially available) is provided near the building foundation 12, as shown in FIGS. 1A and 6, 7A–7D. Other optional equipment includes fence 16, stairway 21 and balcony 22 with handrails. A lower elevational building section 18 is supported within tower base 17. The tower base 17 is preferably an extension of the foundation cap 15, all of which can be, for example, reinforced concrete.

A plurality of building sections 18, 20, 31 are optionally provided one atop the other. When these three building sections 18, 20, 31 are assembled together, they provide foundation columns 19 connecting the building sections together and can be used for supporting tower 30. Columns 19 transfer load between tower 30 and foundation 12. Tower 30 is preferably a self-supporting tower as shown in FIGS. 1 and 1A, but can be any of the tower constructions shown in FIGS. 7A–7D as will be explained more fully hereinafter.

The building sections 18, 20, 31 preferably include a lower elevation building section 18, an upper elevation building section 20, and optionally, a third floor building section 31. In FIGS. 1–1A, the building sections share a common floor/ceiling. For example, the ceiling for lower section 18 is the floor slab for the upper section 20. Each of the building sections 18, 20, 31 has one or more doors 23, one or more cable access ports 24, as well as one or more HVAC (heating, ventilation, and air conditioning) units 25.

Antenna cable 26 is used to interface each of the building sections 18, 20 and 31 with antennae 64, 66, 68 respectively. The tower 30 can be provided with a hoist 27. The surrounding earth 11 can provide a stone, asphalt or concrete apron 28, fence 16 and gate 29.

Figure 3:
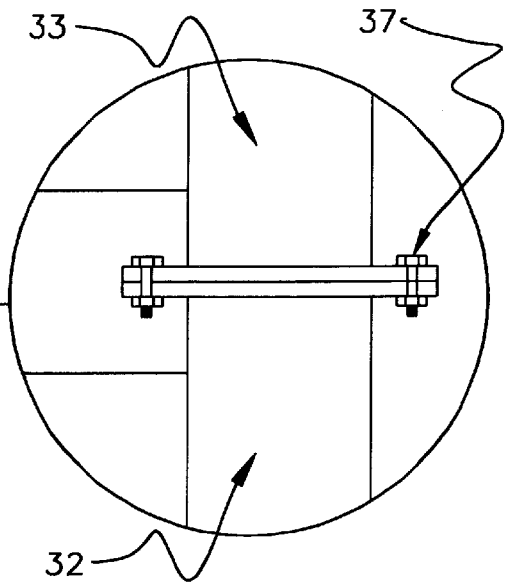
FIG. 3 is a fragmentary view of the preferred embodiment of the apparatus of the present invention illustrating the connection between columns associated with different of the various buildings.
Figure 2:
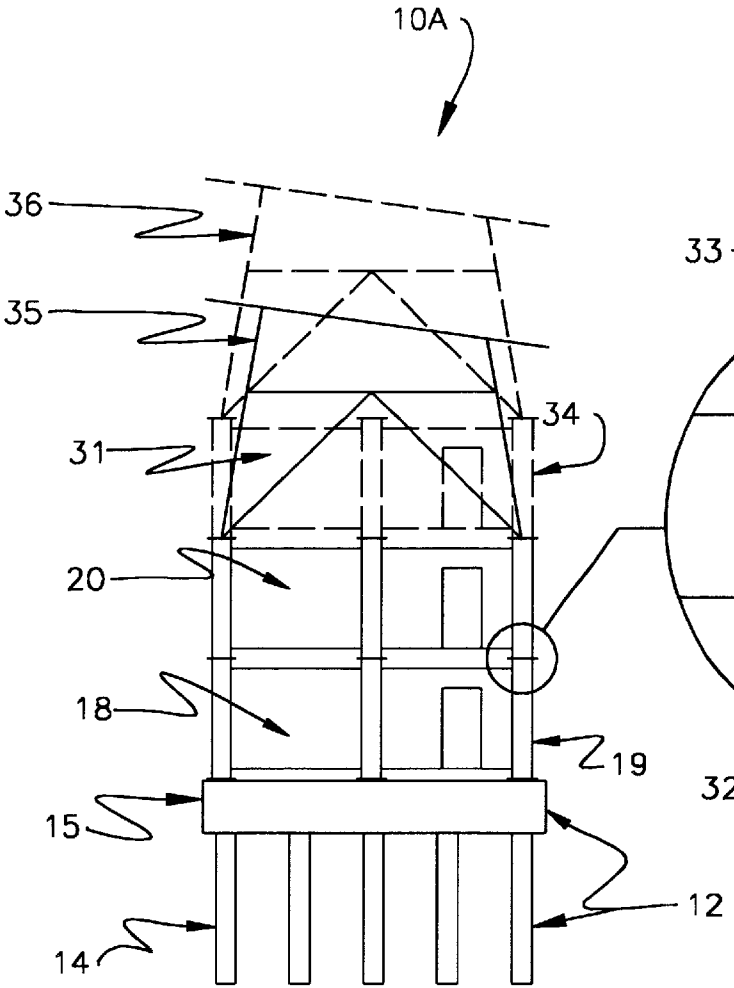
FIG. 2 is a fragmentary, elevation view of an alternate embodiment of the apparatus of the present invention.
Figure 4:
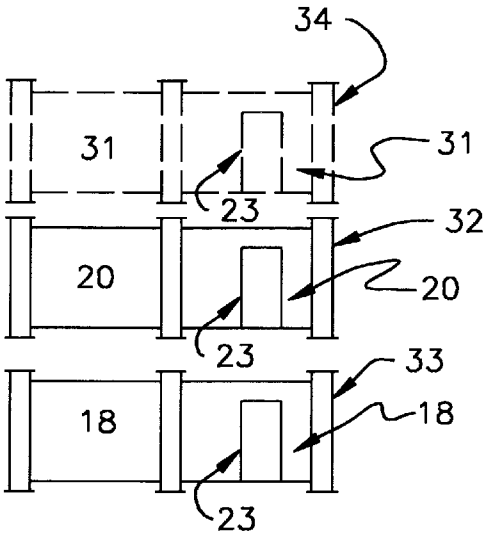
FIG. 4 is a partial, elevation exploded view illustrating the optional 3 building sections that occupy different elevational positions.

A column support arrangement is provided for defining an interface between the various building sections 18, 20, 31, the building foundation 12, and in some situations, the tower such as self-supporting tower 30. Lower building column 32 is shown in FIGS. 3 and 4 as being connected (preferably bolted) to a second floor building column 33. In situations wherein three building sections (three floors) are provided, a third floor building column 34 is provided. As shown in FIGS. 2–4, these building columns 32, 33, 34 can be bolted together using bolted connections 37. However, one piece columns 19 (e.g., Concrete or steel) can be used in place of the column sections 32, 33, 34.

In FIG. 2, an alternate construction, designated as 10A is shown wherein the position of the tower 30 is shown in dotted lines, depending upon whether there are two floors or three floors. The tower position is indicated as 35 wherein two building sections (two floors) are provided. The tower position is indicated by the numeral 36 wherein there are three building sections 18, 20, 31 (three floors). In FIGS. 2, 3 column sections 32, 33, 34 are bolted together.

Figure 6:
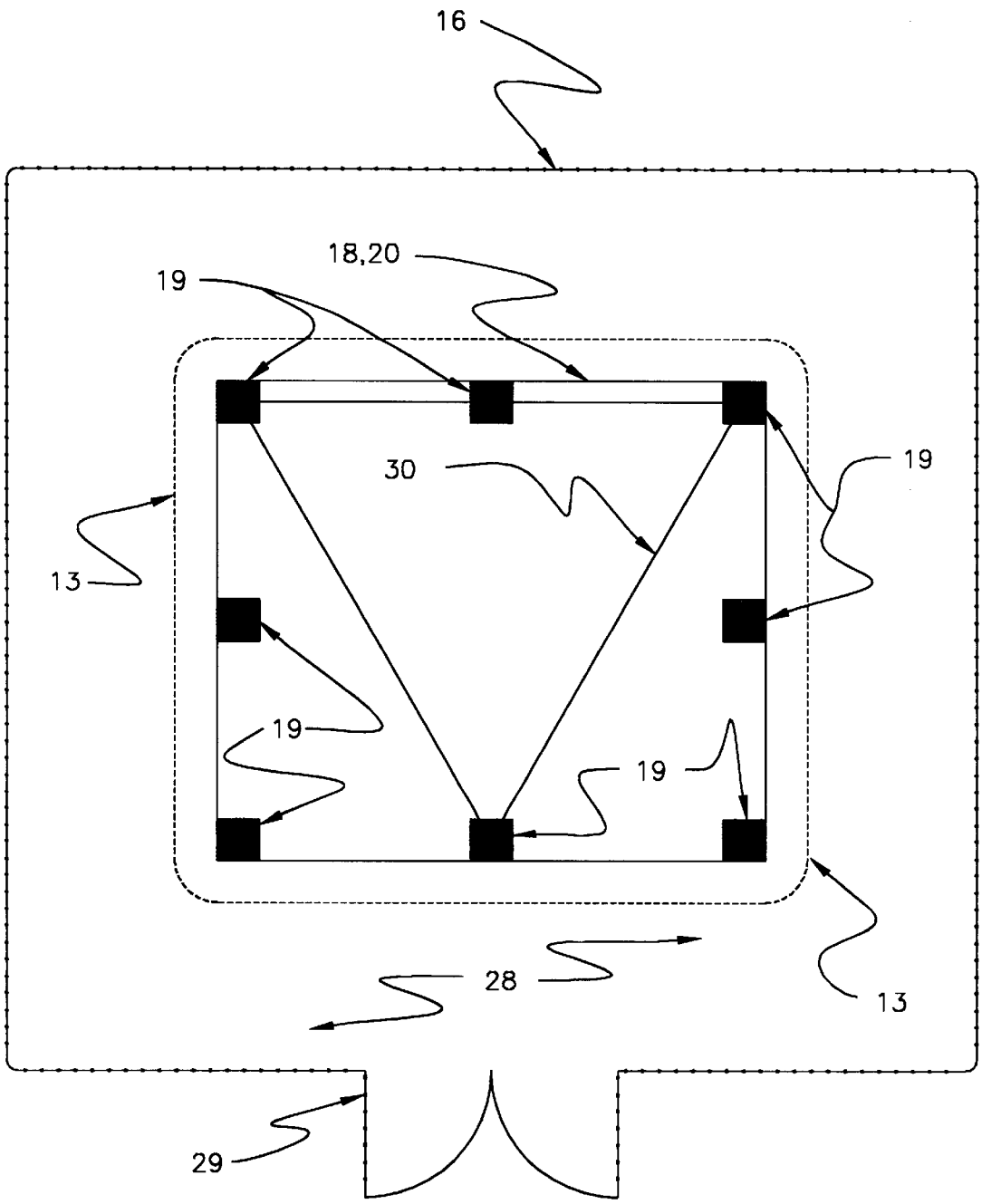
FIG. 6 is a plan view of the preferred embodiment of the apparatus of the present invention.

In the plan view of FIG. 6, the aligned building columns 19 or 32, 33, 34 are arranged around the periphery of the building that is defined by the three building sections 18, 20 31. In FIG. 6, the self supporting triangularly shaped tower 30 is shown for purposes of illustration.

Figure 7A:
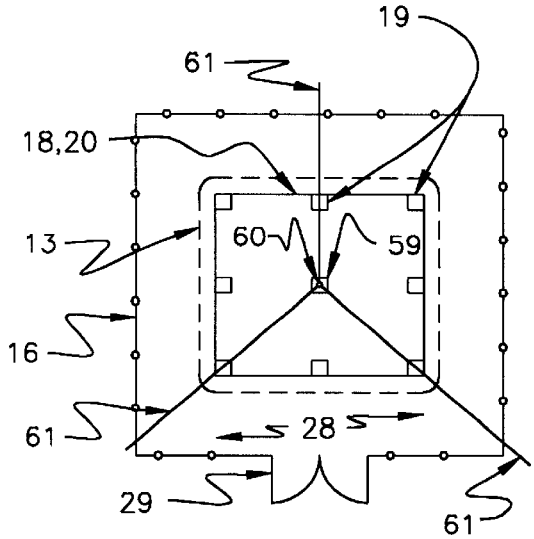
FIGS. 7A–7D are plan views of alternate tower constructions that can be used as part of the apparatus of the present invention.

In FIGS. 7A–7D, other tower arrangements are shown that can be used keeping with the method and apparatus of the present invention. In FIG. 7A, a guyed tower 60 is shown supported upon column 59. The columns 59 can be centered but does not have to be. A corner column 19 can be used. Guy wires extend beyond the fence 16 to anchors (not shown) such as for example piling that are driven into the earth for holding the guy wire 61.

Figure 7B:
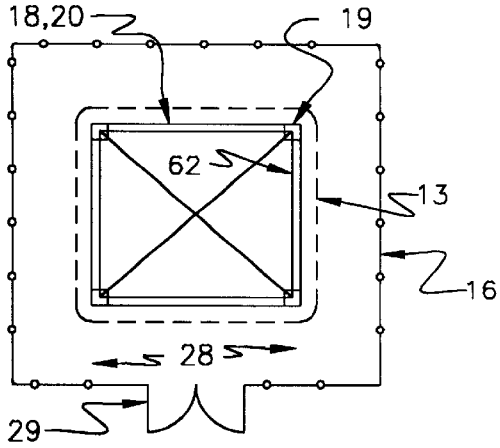

In FIG. 7B, a self-supporting tower 62 is shown which is similar to the tower 30, but which is rectangular or square in cross section as shown in FIG. 7B.

Figure 7C:
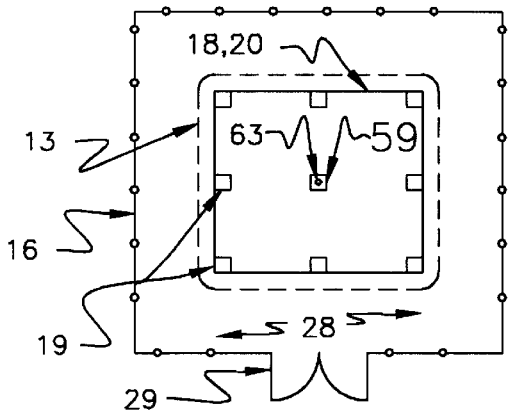

In FIG. 7C, a monopole 63 arrangement is provided wherein one or more monopoles 63 sit upon respective columns 59 (only one is shown for purposes of clarity). In FIG. 7C, the monopole 63 is self-supporting.

Figure 7D:
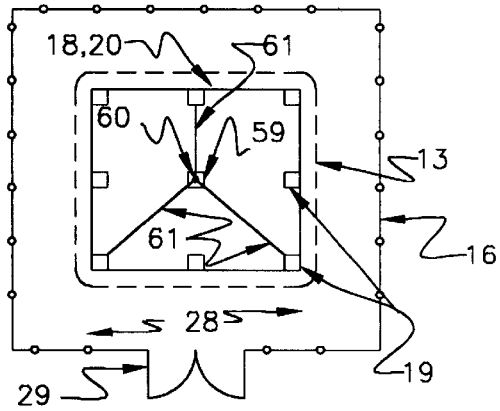

In FIG. 7D, a guyed tower is shown similar to the embodiment of FIG. 7A. The same column 59 and tower 60 are shown in FIG. 7D. The guy wires 61 however, are attached to columns 19, rather than to the earth as with the embodiment of FIG. 7A.

Figure 8:
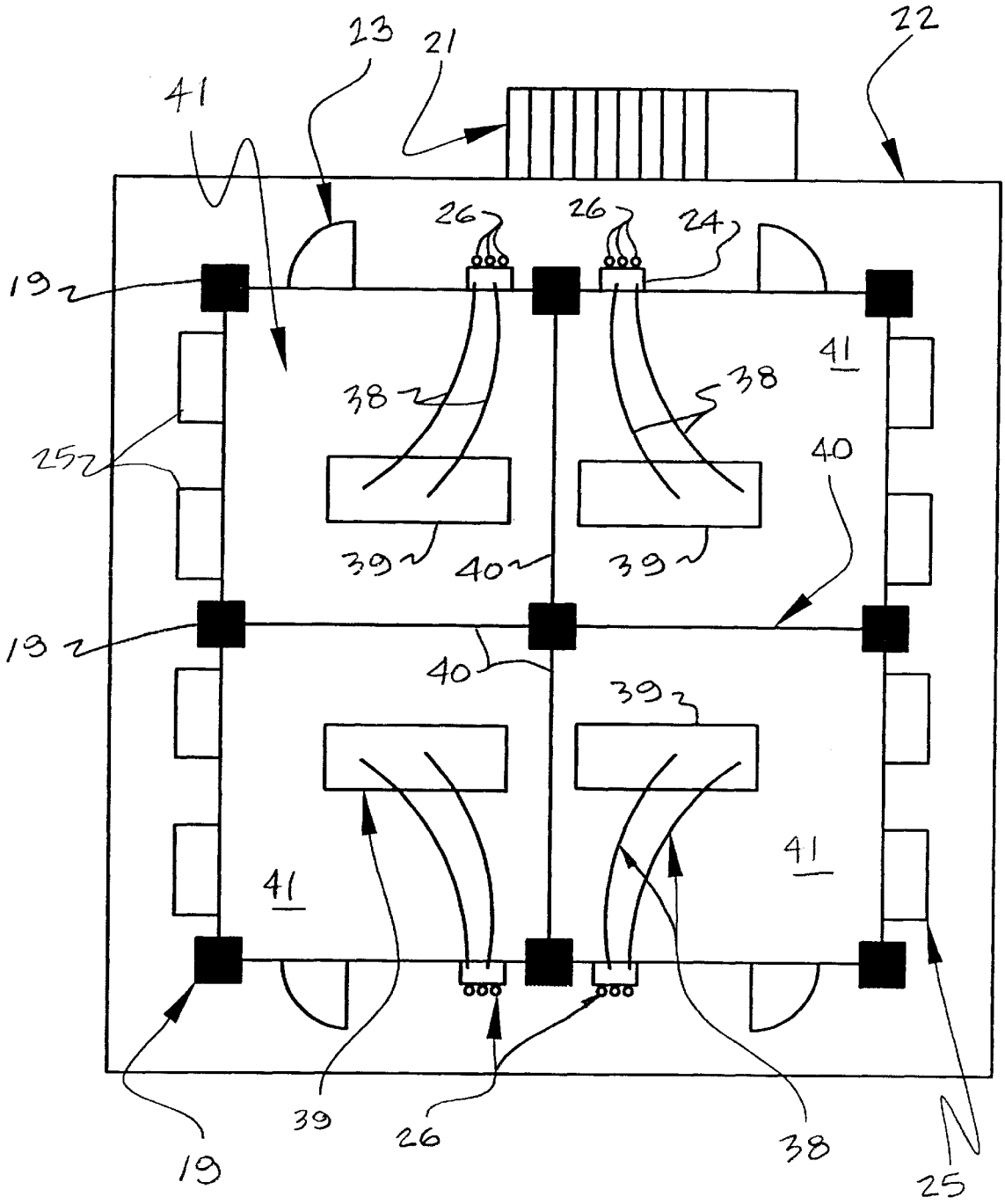
FIG. 8 is a fragmentary view illustrating a floor plan for one of the building section portions of the preferred embodiment of the apparatus of the present invention.
Figure 9:
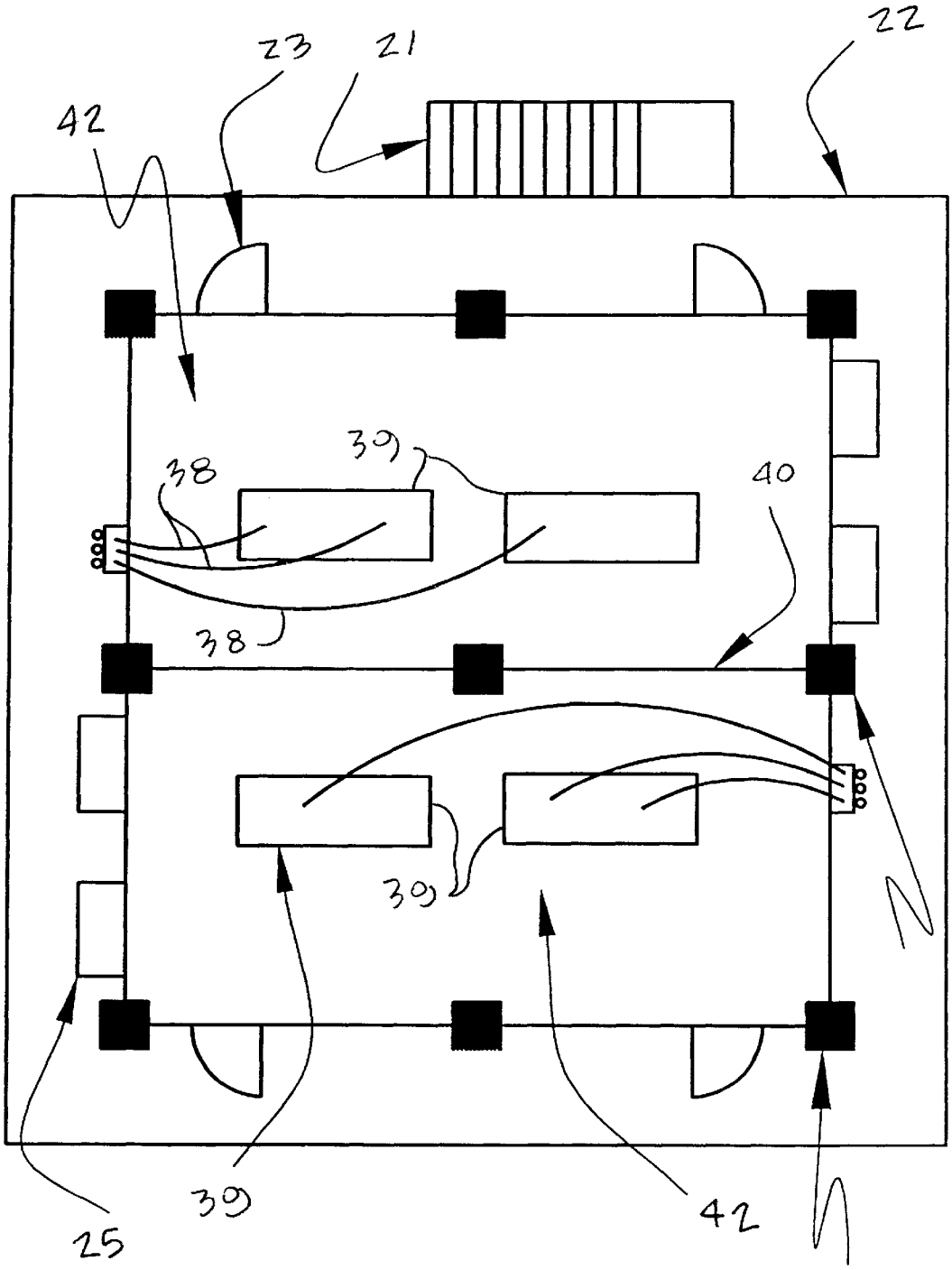
FIG. 9 is another partial plan view of a building section of the preferred embodiment of the apparatus of the present invention.

Floor plans are shown in FIGS. 8 and 9 as exemplary for each of the different building sections 18, 20, 31. In FIG. 8, four different equipment rooms 41 are shown, each having telecommunications equipment 39 to which is connected an interior cable 38. The interior cable 38 is connected to the exterior antenna cable 26 that travels up the tower (such as tower 30) for connection to the selected antenna 64, 66, 68. Interior walls 40 separate the rooms 41.

In FIG. 9, two equipment rooms 42 are shown separated by walls 40.

Figure 5:
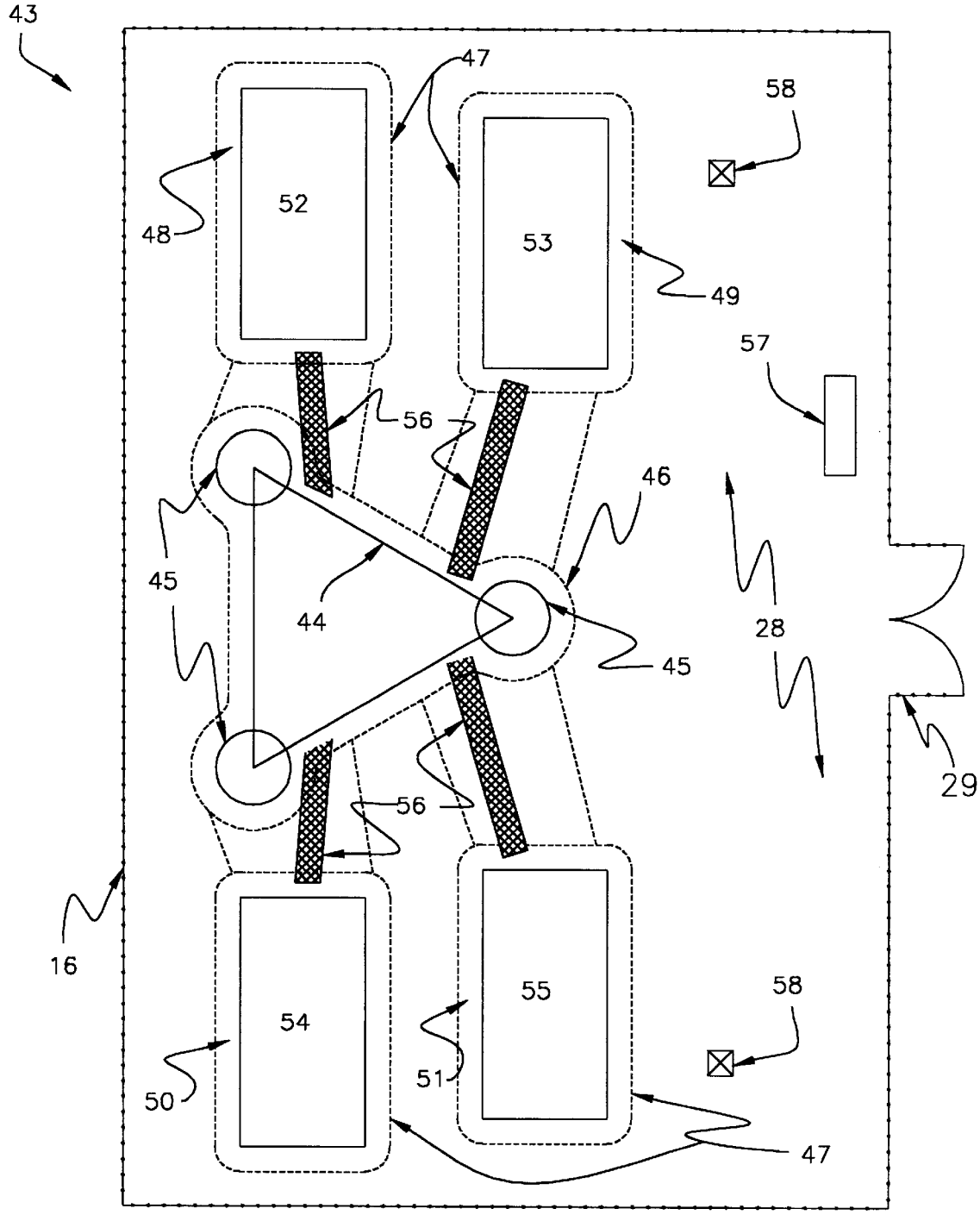
FIG. 5 is a schematic plan view of a typical prior art tower and building layout.

In FIG. 5, an existing, prior art tower and building system is shown, designated generally by the numeral 43. Tower 44 is supported upon a tower foundation 45. A tower ground ring 46 surrounds tower foundation 45. A building ground ring 47 surrounds each building equipment pad 48, 49, 50, 51. In the existing prior art shown in FIG. 5, four separate buildings (or equipment cabinets) 52, 53, 54, 55 are supported respectively by separate equipment pads 48, 49, 50, 51. Each of these pads requires its own ground ring 47.

In the prior art example of FIG. 5, ice bridges 56 are used to cover cabling that extends from each of the separate buildings or equipment cabinets 52–55 to tower 44. Electrical backboard foundation 57 and transformer pad foundation 58 are also shown in FIG. 5.

A third embodiment of the apparatus of the present invention could be provided to provide a building that is of a single level as opposed to the two and three and four level constructions that are discussed above. In the third embodiment, the single building would support the tower such as a self-supporting tower or any of the towers in FIGS. 7A–7D. However, the single building would provide multiple secured areas such as for example, 2, 4 or 6 rooms separated by permanent walls. In the third embodiment, each secured area (room) has its own antenna portal through the exterior wall of the building, its own antenna cabling, and its own set of antennae at a selected elevational position. In other words, each secured area or room has its own set of antennae at its own elevational position on the common tower.

The following is a list of parts and materials suitable for use in the present invention:

PARTS LIST

| Part Number | Description |
|---|---|
| 10 | antenna tower and support apparatus |
| 10A | antenna tower and support apparatus |
| 11 | earth's surface |
| 12 | building foundation |
| 13 | building ground ring |
| 14 | piling |
| 15 | foundation cap |
| 16 | fence |
| 17 | tower base |
| 18 | lower elevation building section |
| 19 | column |
| 20 | upper elevation building section |
| 21 | stairway |
| 22 | balcony |
| 23 | door |
| 24 | cable access port |
| 25 | hvac unit |
| 26 | antenna cable |
| 27 | hoist |
| 28 | apron |
| 29 | gate |
| 30 | three-sided self supporting tower |
| 31 | third floor building section |
| 32 | lower building column |
| 33 | second floor building column |
| 34 | third floor building column |

-continued

PARTS LIST

| Part Number | Description |
|---|---|
| 35 | tower position (two floors) |
| 36 | tower position (three floors) |
| 37 | bolted connection |
| 38 | interior cable |
| 39 | telecommunication equipment |
| 40 | interior wall |
| 41 | equipment room |
| 42 | equipment room |
| 43 | tower and building system |
| 44 | tower |
| 45 | tower foundation |
| 46 | tower ground ring |
| 47 | building ground ring |
| 48 | equipment pad |
| 49 | equipment pad |
| 50 | equipment pad |
| 51 | equipment pad |
| 52 | building/equipment cabinet |
| 53 | building/equipment cabinet |
| 54 | building/equipment cabinet |
| 55 | building/equipment cabinet |
| 56 | ice bridge |
| 57 | electrical backboard foundation |
| 58 | transformer pad foundation |
| 59 | column |
| 60 | guy tower |
| 61 | guy wire |
| 62 | four-sided self supporting tower |
| 63 | monopole |
| 64 | panel antenna |
| 65 | elevational position |
| 66 | whip antenna |
| 67 | elevational position |
| 68 | microwave dish antenna |
| 69 | elevational position |
| 70 | ground rod |

the foregoing embodiments are presented by way of example only; the scope of the present invention is to be limited only by the following claims.

What is claimed is:

1. An antenna tower and support apparatus, comprising:

a) a foundation;

b) a multistory building mounted on the foundation, including a plurality of vertically spaced apart building sections that include at least a bottom section positioned next to the foundation and a top section, each building section defining a separate floor of the multistory building;

c) an open tower supported upon the multistory building and above the top section, the tower comprising only exposed structural connecting members and not being covered, enabling wind load to be minimized;

d) a plurality of antennas attached to the tower at multiple elevational positions;

e) each building section having a security area that is separate from the security area of other building sections;

f) a plurality of antenna portals, at least one provided on each building section;

g) a plurality of antenna cables, each cable extending from an antenna to a security area of a building section via an antenna portal, wherein each security area has at least one antenna cable that extends to it; and h) each security area having telecommunication equipment that is connected to one of said antenna cables.

2. The antenna tower and support apparatus of claim 1 wherein the open tower is a self supporting tower.

3. The antenna tower and support apparatus of claim 1 wherein the open tower is a guyed tower.

4. The antenna tower and support apparatus of claim 1 wherein the open tower is a monopole tower.

5. The antenna tower and support apparatus of claim 1 wherein the open tower is a guyed tower that is guyed to the top of the building.

6. The antenna tower and support apparatus of claim 1 wherein at least one of the building sections has multiple antenna cables that enter its security area via an antenna portal.

7. The antenna tower and support apparatus of claim 1 wherein the multiple antennas include at least one microwave antenna.

8. The antenna tower and support apparatus of claim 1 wherein the multiple antennas include at least one whip antenna.

9. The antenna tower and support apparatus of claim 1 wherein the multiple antennas include at least one panel antenna.

10. The antenna tower and support apparatus of claim 1 wherein the multiple antennas include at Least one microwave antenna and at least one panel antenna.

11. The antenna tower and support apparatus of claim 1 wherein the multiple antennas include at least one microwave antenna and at least one whip antenna.

12. The antenna tower and support apparatus of claim 1 wherein the multiple antennas include at least one whip antenna and at least one panel antenna.

13. The antenna tower and support apparatus of claim 1 further comprising a single ground ring grounded below the earth's surface next to the building.

14. The antenna tower and support apparatus of claim 13 wherein multiple of the building sections have connections to the ground ring.

15. The antenna tower and support apparatus of claim 14 wherein each building has electronic equipment that is grounded to the ground ring.

16. The antenna tower and support apparatus of claim 14 wherein each building has metallic equipment that is grounded to the ground ring.

17. The antenna tower and support apparatus of claim 1 wherein the foundation has a periphery and a central portion and the tower is supported entirely within the confines of the foundation periphery.

18. The antenna tower and support apparatus of claim 17 further comprising guy wire supports that support the tower and which extend beyond the periphery of the foundation.

19. The antenna tower and support apparatus of claim 1 wherein the foundation has a footprint and the building and the tower each fit inside of the footprint.

20. The antenna tower and support apparatus of claim 1 wherein each antenna portal closely conforms to the building.

21. An antenna tower and support apparatus, comprising:

a) a foundation;

b) a multistory building mounted on the foundation, including a plurality of vertically spaced apart building sections that include at least a bottom section positioned next to the foundation and a top section, and a plurality of load bearing columns that span vertically from the bottom section to the top section;

c) a tower supported upon the top section of the building;

d) a plurality of antennas attached to the tower at multiple elevational positions;

e) each building section defining a separate floor of the multistory building having a security area that is separate from the security area of other building sections;

f) a plurality of antenna portals, at least one provided on each building section;

g) a plurality of antenna cables, each cable extending from an antenna to a security area of a building section via an antenna portal, wherein each security area has at least one antenna cable that extends to it; and h) each security area having telecommunication equipment that is connected to on of said antenna cables.

22. The antenna tower and support apparatus of claim 15 wherein the columns each comprise connected together vertical column sections.

23. The antenna tower and support apparatus of claim 15 wherein the tower has tower legs, each leg of the tower supported by a column.

24. The antenna tower and support apparatus of claim 15 wherein the tower is a self supporting tower.

25. The antenna tower and support apparatus of claim 15 wherein the tower is a guyed tower.

26. The antenna tower and support apparatus of claim 15 wherein the tower is a monopole tower.

27. The antenna tower and support apparatus of claim 15 wherein at least one of the building sections has multiple antenna cables that enter its security area via an antenna portal.

28. The antenna tower and support apparatus of claim 15 wherein the multiple antennas include at least one microwave antenna.

29. The antenna tower and support apparatus of claim 15 wherein the multiple antennas include at least one whip antenna.

30. The antenna tower and support apparatus of claim 15 wherein the multiple antennas include at least one panel antenna.

31. The antenna tower and support apparatus of claim 15 wherein the multiple antennas include at least one microwave antenna and at least one panel antenna.

32. The antenna tower and support apparatus of claim 15 wherein the multiple antennas include at least one microwave antenna and at least one whip antenna.

33. The antenna tower and support apparatus of claim 15 wherein the multiple antennas include at least one whip antenna and at least one panel antenna.

34. The antenna tower and support apparatus of claim 15 further comprising a single ground ring grounded below the earth's surface next to the building.

35. The antenna tower and support apparatus of claim 34 wherein multiple of the building sections have connections to the ground ring.

36. The antenna tower and support apparatus of claim 21 wherein the foundation has a periphery and a central portion and the tower is supported entirely within the confines of the foundation periphery.

37. The antenna tower and support apparatus of claim 36 further comprising guy wire supports that support the tower and which extend beyond the periphery of the foundation.

38. The antenna tower and support apparatus of claim 21 wherein the foundation has a footprint and the building and the tower each fit inside of the footprint.

39. The antenna tower and support apparatus of claim 21 wherein each antenna portal closely conforms to the building.

40. An antenna tower and support apparatus, comprising:

a) a foundation;

b) a multistory building mounted on the foundation, including a plurality of vertically spaced apart building sections that include at least a bottom section positioned next to the foundation and a top section, and a plurality of load bearing columns that span vertically from the bottom section to the top section;

c) an open tower supported upon the multistory building and above the top section, the tower comprising only exposed structural connecting members and not being covered, enabling wind load to be minimized;

d) a plurality of antennas attached to the tower at multiple elevational positions;

e) each building section defining a separate floor of the multistory building having a security area that is separate from the security area of other building sections;

f) a plurality of antenna portals, at least one provided on each building section;

g) a plurality of antenna cables, each cable extending from an antenna to a security area of a building section via an antenna portal, wherein each security area has at least one antenna cable that extends to it; and h) each security area having telecommunication equipment that is connected to on of said antenna cables.

* * * * *